United States Patent [19]

Ames et al.

[11] Patent Number: 4,966,067

[45] Date of Patent: Oct. 30, 1990

[54] INVOLUTE CAM ACTUATOR WITH PISTON DRIVE

[75] Inventors: John Ames, Spring Lake, Mich.; David J. Lang; Richard E. Walsh, both of Rockford, Ill.

[73] Assignee: Sundstrand Corporation, Rockford, Ill.

[21] Appl. No.: 315,715

[22] Filed: Feb. 27, 1989

[51] Int. Cl.[5] ..... F01B 7/00

[52] U.S. Cl. ..... 92/150; 92/129; 92/151; 92/146; 92/147; 74/55; 74/569

[58] Field of Search ..... 92/72, 73, 74, 129, 92/138, 146, 150, 151, 147; 74/55, 569

[56] References Cited

U.S. PATENT DOCUMENTS

| | | | |
|---|---|---|---|
| 1,723,874 | 8/1929 | Lunge | 92/73 |
| 2,010,377 | 8/1935 | Sassen | 417/539 |
| 2,882,831 | 4/1959 | Dannevig | 91/498 |

FOREIGN PATENT DOCUMENTS

| | | | |
|---|---|---|---|
| 465594 | 9/1928 | Fed. Rep. of Germany | 74/55 |
| 500538 | 11/1954 | Italy | 92/72 |
| 34148 | 12/1967 | Japan | 92/72 |

*Primary Examiner*—Edward K. Look
*Assistant Examiner*—Thomas Denion
*Attorney, Agent, or Firm*—Antonelli, Terry, Stout & Kraus

[57] ABSTRACT

A mechanism for converting linear displacement of a piston to angular displacement of a shaft by positioning a cam in a recess of a unitary piston which is adapted for positioning by differential fluid forces applied to opposite ends of the piston. To provide a linear displacement drive for a shaft positioned to rotate about an axis perpendicular to the axis of the piston, a cam profile consisting of two symmetrical, opposite and identical involutes is employed.

9 Claims, 1 Drawing Sheet

INVOLUTE CAM ACTUATOR WITH PISTON DRIVE

1. Technical Field:

This invention relates to the control of angular rotation of a shaft by a fluid pressure applied to cause displacement of a piston, or vice versa, under conditions such that a linear relationship is established between the piston displacement and the angular rotation of a shaft.

2. Background Art:

Many industrial applications require a linear or constant relation between the angular movement of a shaft and linear movement of a piston or bar in a straight line. A commonly used mechanism is a rack and pinion. U.S. Pat. No. 4,167,897 granted Sept. 18, 1979 discloses a rotary fluid pressure actuator which comprises a cylinder with two pistons, each integral with a rack and the two racks engaging opposite sides of a pinion mounted for rotation about an axis that is perpendicular to the cylinder at mid-length. Conversion of fluid energy to shaft rotational displacement may be accomplished by devices such as a rotary vane device, pistons employing linkages and sliding elements. Complications arise from vane type devices because of their inherent asymmetry, particularly with regards to sealing. Similarly, mechanization relating to conversion of linear piston motion to shaft rotation may involve numerous components, and with linkages, their inherent non-linear relationship of shaft rotation to piston displacement.

DISCLOSURE OF INVENTION

It is a major object of the present invention to provide a novel mechanism that converts fluid pressure into a linear displacement by acting on a piston which in turn causes angular displacement of a shaft.

It is a further object to provide a piston having spaced cam engaging surfaces and a shaft mounted cam so shaped as to provide a constant width between the cam engaging surfaces wherein the cam profile is shaped to provide the linear relationship between the piston displacement and angular displacement of the shaft.

It is a further object to provide a novel cam profile consisting of two symmetrical, opposite and identical involutes wherein the cam width measured along a line tangent to the involute base circle is invariant with respect to angular position.

These and other objects of the invention will become more fully apparent from the claims and from the description when read in conjunction with the drawings.

BEST MODE FOR CARRYING OUT THE INVENTION

Figure 1:
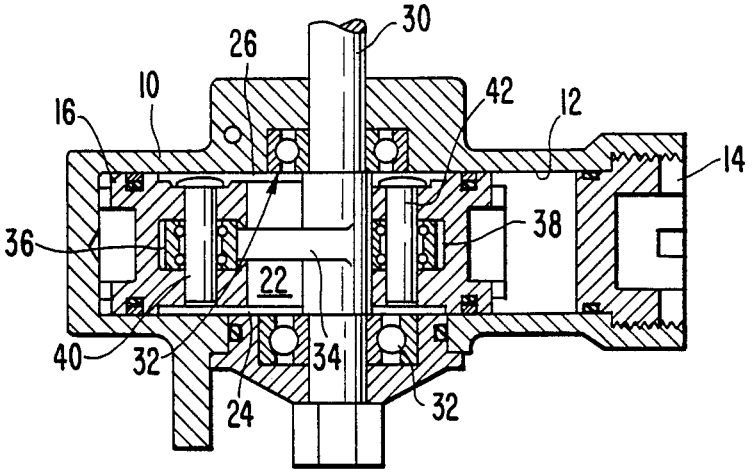
FIG. 1 is a top plan view with a top cover removed to show a cam actuator mechanism embodying the present invention.

A housing 10 is provided with a cylindrical wall that may be formed through the right end portion that is closed by an end cap 14. The piston 16 has a pressure face 18 on the left side and a pressure face 20 on the right side in chambers that are connected to pressurized fluid such as a hydraulic liquid. A recess 22 is provided at a central portion of piston 16 that has front and rear walls 24, 26, the upper edges 28 of which are shown by dotted lines in FIG. 2. The front and rear walls 24, 26 rigidly join the left and right sides of the piston together as a unitary body.

The output shaft 30 is mounted for rotation as by bearings 32 about an axis that is at a right angle to the axis of the cylinder formed by wall 12. Output shaft 30 has formed thereon as an integral part, a cam 34 which has an outer peripheral surface 35 that can rotate within the recess 22 of piston 16.

Each side of piston 16 has a cam engaging surface which is preferably in the form of rollers 36, 38. The rollers 36, 38 are mounted on shafts 40, 42 respectively, which are rigidly mounted on the different sides of the piston. The rotational axes of the shafts 40, 42 are shown parallel to the axis of shaft 30 and may be positioned to intersect the axis of the cylinder having walls 12.

To prevent backlash, the cam surface 35 must be shaped to present a constant distance between the points of engagement of rollers 36, 38 with the cam surface 35. To provide a linear relationship between the axial displacement of the piston 16 and the angular displacement of shaft 30, the cam surface 35 must have the shape of an involute curve on both the upper and lower sides as viewed in FIG. 2.

Figure 2:
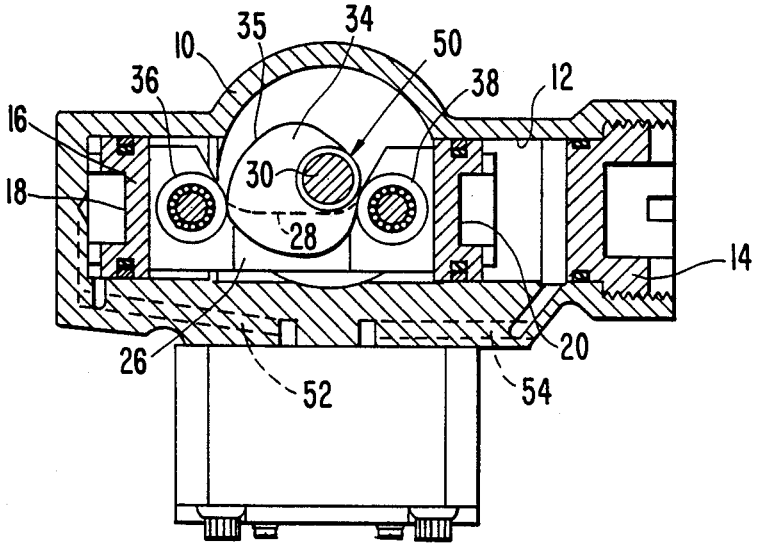
FIG. 2 is a front elevation of FIG. 1 with the front wall removed to show the cam profile.

One roller 36 is always in engagement with the upper involute curve and the other roller 38 is always in engagement with the lower involute curve as shown in FIG. 2. An involute curve has a base circle 50. The axis of the involute base circle 50, which is coaxial with the axis of shaft 30, is positioned so that a line extending between the points of contact of rollers 36, 38 will be substantially tangent to the base circle 50 of the two involute curves.

A detailed analysis of the involute cam profile demonstrates that in the preferred arrangement illustrated, the cam profile should consist of two symmetrical, opposite and identical involutes so that the cam width measured tangent to the involute base circle is invariant with respect to the angular position of the cam. In the arrangement shown in FIG. 2, this results in a constant minimal clearance between the rollers 36, 38, thus minimizing lost motion under conditions of pressure reversal. Piston displacement is an exact linear relationship to shaft rotation. In this regard, piston displacement is equivalent to a rack and pinion combination, wherein the pinion pitch radius is equal to the involute cam base circle radius.

Lateral reaction forces from the cam 34 to the piston 16 are very small since the local surface presented by the cam 34 to the rollers 36, 38 is substantially perpendicular to the piston axis for all shaft rotational positions within the range of the involute profile.

Piston 16 is shown in a limit position against the left wall of housing 10 and cam 35 is shown in its clockwise limit position. As the fluid pressure is applied to cause fluid flow through channel 52 to the left side of the cylinder, piston 16 moves to the right and fluid flow returns through channel 54. Displacement of piston 16 thus causes counterclockwise rotation of cam 35 and its shaft 30. Where the shape of the cam surface 35 comprises two involute curves as illustrated in FIG. 2, the angular displacement is uniformly and linearly related to the displacement of piston 16 just as if a rack and pinion were used.

While only a single embodiment of the present invention has been disclosed, it is apparent that the mechanism will also operate with inputs and outputs reversed, and it is intended that all modifications and changes which fall within the scope of the appended claims are to be covered thereby.

We claim:

1. A mechanism for producing a linear relationship between angular movement of a shaft and axial movement of a piston comprising:

a piston operating along an axis of a cylinder and having first and second fluid pressure faces at opposite ends thereof;

a recess in a central portion of said piston;

a shaft mounted for rotation about an axis that extends transversely to said cylinder axis and having fixed thereto a cam member which is mounted for angular movement about the shaft axis in said recess;

cam engaging surfaces mounted on said piston with an invariant spacing at opposite sides of the recess and in constant engagement with opposed sides of said cam member; and said cam member having a shape such that linear movement of the piston has a linear relationship with the angular movement of said shaft through a stroke which extends from both sides of a central position of said piston whereby, upon an application of a fluid pressure on one of said first and second fluid pressure faces of said piston, the piston is linearly moved causing an associated cam engaging surface to engage the cam member and rotate said shaft.

2. A mechanism as defined in claim 1 wherein the cam surface has the shape of a pair of involute curves which each extend from a base circle of said involute.

3. A mechanism as defined in claim 2 wherein said involute curves are symmetrical, opposite and identical and the center of a base circle of the involute curves is coincident with the rotational axis of said shaft.

4. A mechanism as defined in claim 1 further including means for applying a differential fluid pressure to the opposite faces of said piston for controlling the linear movement of the piston from a central position in said cylinder to thereby produce the rotation of said shaft.

5. A mechanism as defined in claim 1, wherein the rotational axis of said shaft is perpendicular to the axis of said cylinder and located so that a line extending through points of engagement between the cam engaging surfaces and involute curves of the cam member is substantially tangent to a base circle of the involute curves.

6. A mechanism as defined in claim 1, wherein the cam engaging surfaces on said piston include rollers mounted for rotation about axes that are parallel to each other and to the rotational axis of the shaft, and wherein a plane defined by said roller axis is substantially tangent to a base circle of involute curves forming said cam engaging surfaces.

7. A mechanism for producing a linear relationship between angular movement of a shaft and axial movement of a piston comprising:

a piston operating along an axis of a cylinder and having first and second fluid pressure faces at opposite ends thereof;

a recess in a central portion of said piston;

a shaft mounted for rotation about an axis that extends transversely to said cylinder axis and having fixed thereto a cam member which is mounted for angular movement about the shaft axis in said recess;

cam engaging surfaces mounted on said piston with an invariant spacing at opposite sides of the recess and in constant engagement with opposed sides of said cam member, said cam engaging surfaces have the shape of a pair of involute curves which each extend from a base circle of the involute, said involute curves are symmetrical, opposite and identical and the center of a base circle of the involute curves is coincident with the rotational axis of said shaft;

said cam member having a shape such that linear movement of the piston has a linear relationship with the angular movement of said shaft through a stroke which extends from both sides of a central position of said piston; and wherein the rotational axis of said shaft is perpendicular to the axis of said cylinder and located so that a line extending through points of engagement between the cam engaging surfaces and the cam is substantially tangent to the base circle of the involute curves.

8. A mechanism for producing a linear relationship between angular movement of a shaft and axial movement of a piston comprising:

a piston operating along an axis of a cylinder and having first and second fluid pressure faces at opposite ends thereof;

a recess in a central portion of said piston;

a shaft mounted for rotation about an axis that extends transversely to said cylinder axis and having fixed thereto a cam member which is mounted for angular movement about the shaft axis in said recess;

cam engaging surfaces mounted on said piston with an invariant spacing at opposite sides of the recess and in constant engagement with opposed sides of said cam member, said cam engaging surfaces have the shape of a pair of involute curves which each extend from a base circle of the involute, said involute curves are symmetrical, opposite and identical and the center of a base circle of the involute curves is coincident with the rotational axis of said shaft;

said cam member having a shape such that linear movement of the piston has a linear relationship with the angular movement of said shaft through a stroke which extends from both sides of a central position of said piston; and wherein the cam engaging surfaces on said piston are rollers that are mounted for rotation about axes that are parallel to each other and to the rotational axis of said shaft, and a plane defined by said roller axis is substantially tangent to the base circle of said involute curves.

9. A mechanism for producing a linear relationship between angular movement of a shaft and axial movement of a piston comprising:

a piston operating along an axis of a cylinder and having first and second fluid pressure faces at opposite ends thereof;

a recess in a central portion of said piston;

a shaft mounted for rotation about an axis that extends transversely to said cylinder axis and having fixed thereto a cam member which is mounted for angular movement about the shaft axis in said recess;

cam engaging surfaces mounted on said piston with an invariant spacing at opposite sides of the recess and in constant engagement with opposed sides of said cam member, said cam engaging surfaces have the shape of a pair of involute curves which each extend from a base circle of the involute, said involute curves are symmetrical, opposite and identical and the center of a base circle of the involute curves is coincident with the rotational axis of said shaft;

said cam member having a shape such that linear movement of the piston has a linear relationship with the angular movement of said shaft through a stroke which extends from both sides of a central position of said piston; and means for applying a differential fluid pressure to the opposite faces of said piston for controlling the displacement of the piston form a central position in said cylinder to thereby produce a predetermined angular movement of said shaft.

* * * * *